US012692703B2

(12) United States Patent
Boo

(10) Patent No.: US 12,692,703 B2
(45) Date of Patent: Jul. 28, 2026

(54) CONNECTION ARRANGEMENT FOR PANELS

(71) Applicant: Välinge Innovation AB, Viken (SE)

(72) Inventor: Christian Boo, Kågeröd (SE)

(73) Assignee: VÄLINGE INNOVATION AB, Viken (SE)

( * ) Notice: Subject to any disclaimer, the term of this patent is extended or adjusted under 35 U.S.C. 154(b) by 167 days.

(21) Appl. No.: 18/422,368

(22) Filed: Jan. 25, 2024

(65) Prior Publication Data

US 2024/0254768 A1 Aug. 1, 2024

(30) Foreign Application Priority Data

Jan. 27, 2023 (SE) ..... 2350077-0
Apr. 27, 2023 (SE) ..... 2350509-2

(51) Int. Cl.
*E04C 2/40* (2006.01)
*E04C 2/00* (2006.01)
(Continued)

(52) U.S. Cl.
CPC ..... *E04C 2/40* (2013.01); *E04C 2/10* (2013.01); *E04C 5/20* (2013.01); *E04C 2002/001* (2013.01)

(58) Field of Classification Search
CPC ..... E04C 2/40; E04C 2/10; E04C 2/20; E04C 2002/001
See application file for complete search history.

(56) References Cited

U.S. PATENT DOCUMENTS 7,654,055 B2 * 2/2010 Ricker ..... A47B 47/0075 52/592.1
7,998,549 B2 * 8/2011 Susnjara ..... A47B 67/04 29/466
(Continued)

FOREIGN PATENT DOCUMENTS

CN 109654097 A 4/2019
DE 102014110124 A1 1/2016
(Continued)

OTHER PUBLICATIONS

International Search Report and Written Opinion received for PCT Patent Application No. PCT/SE2024/050064, mailed on Feb. 2, 2024, 15 pages.
(Continued)

*Primary Examiner* — Brian D Mattei
(74) *Attorney, Agent, or Firm* — Boone IP Law

(57) ABSTRACT

A connection arrangement for panels includes a first panel having a first main plane, a second panel having a second main plane, the first main plane is essentially perpendicular to the second main plane in a connected state. The second panel includes a groove on a first face adapted to receive a first protruding edge. The groove has a longitudinal recess on a side for receiving a flexible locking element, the protruding edge has a longitudinal insertion recess on one side of the protruding edge for holding the flexible locking element. The groove includes a first groove section and an adjacent groove section connected by an intermediate groove section. The first edge includes a first protruding section and an adjacent protruding section, wherein the first groove section is configured to cooperate with the first protruding section, and the adjacent groove section is configured to cooperate with the adjacent protruding section.

17 Claims, 7 Drawing Sheets

(51) Int. Cl.
*E04C 2/10* (2006.01)
*E04C 5/20* (2006.01)

(56) References Cited

U.S. PATENT DOCUMENTS

| | | | | |
|---|---|---|---|---|
| 9,714,672 | B2 * | 7/2017 | Derelöv | F16B 5/0614 |
| 10,415,612 | B2 | 9/2019 | Davis et al. | |
| 10,934,721 | B2 * | 3/2021 | Pervan | E04F 15/02038 |
| 11,204,051 | B2 | 12/2021 | Pålsson et al. | |
| 2003/0101681 | A1 * | 6/2003 | Tychsen | E04F 15/04 52/578 |
| 2006/0273085 | A1 * | 12/2006 | Casto | B27G 13/14 403/381 |
| 2015/0196118 | A1 * | 7/2015 | Derelov | F16B 5/0614 403/376 |
| 2015/0368896 | A1 | 12/2015 | Shulte | |
| 2016/0153200 | A1 * | 6/2016 | Pervan | E04F 15/102 52/582.2 |
| 2017/0055702 | A1 | 3/2017 | Sklansky | |
| 2018/0002933 | A1 * | 1/2018 | Pervan | E04F 15/102 |
| 2019/0323532 | A1 * | 10/2019 | Boo | F16B 12/46 |
| 2021/0222716 | A1 * | 7/2021 | Derelöv | F16B 12/14 |
| 2022/0018373 | A1 | 1/2022 | Boo | |

FOREIGN PATENT DOCUMENTS

| | | | | |
|---|---|---|---|---|
| EP | 3456988 | A1 | 3/2019 | |
| FR | 2988274 | A1 | 9/2013 | |
| WO | 2011151758 | A2 | 12/2011 | |
| WO | 2012154113 | A1 | 11/2012 | |
| WO | 2013/118075 | A1 | 8/2013 | |
| WO | WO-2020156954 | A1 * | 8/2020 | F16B 12/26 |

OTHER PUBLICATIONS

U.S. Appl. No. 19/068,325, Oscar Rydsjö, filed Mar. 3, 2025.
U.S. Appl. No. 19/048,028, Oscar Rydsjö, filed Feb. 7, 2025.
U.S. Appl. No. 17/398,416, Thomas Meijer, filed Aug. 10, 2021.
U.S. Appl. No. 17/514,055, Marko Sostar, filed Oct. 29, 2021.
U.S. Appl. No. 17/665,160, Oscar Rydsjö, filed Feb. 4, 2022.
U.S. Appl. No. 17/784,341, Johan Svensson, filed Jun. 10, 2022.
U.S. Appl. No. 17/847,655, Thomas Meijer, filed Jun. 23, 2022.
U.S. Appl. No. 17/870,215, Peter Derelöv, filed Jul. 21, 2022.
U.S. Appl. No. 17/959,010, Mindaugas Zacharenko, filed Oct. 3, 2022.
U.S. Appl. No. 18/058,037, Peter Derelöv, filed Nov. 22, 2022.
U.S. Appl. No. 18/191,404, Thomas Meijer, filed Mar. 28, 2023.
U.S. Appl. No. 18/239,924, Niclas HÅkansson, filed Aug. 30, 2023.
U.S. Appl. No. 18/422,425, Christian Boo, filed Jan. 25, 2024.
U.S. Appl. No. 18/440,330, Thomas Meijer, filed Feb. 13, 2024.
U.S. Appl. No. 18/441,480, Peter Derelöv, filed Feb. 14, 2024.
U.S. Appl. No. 18/271,460, Peter Derelöv, filed Jul. 9, 2023.
U.S. Appl. No. 18/766,880, Thomas Meijer, filed Jul. 9, 2024.
U.S. Appl. No. 19/226,620, Henrik Lindquist, filed Jun. 3, 2025.
U.S. Appl. No. 19/184,232, Thomas Meijer, filed Apr. 21, 2025.
Official Action from the Swedish Patent and Registration Office in corresponding Swedish Application No. 2350077-0, dated Sep. 5, 2023, 9 pages.

* cited by examiner

CONNECTION ARRANGEMENT FOR PANELS

CROSS REFERENCE TO RELATED APPLICATIONS

The present application claims the benefit of Swedish Application No. 2350077-0, filed on Jan. 27, 2023, and Swedish Application No. 2350509-2, filed on Apr. 27, 2023. The entire contents of Swedish Application No. 2350077-0 and Swedish Application No. 2350509-2 are hereby incorporated herein by reference in their entirety.

TECHNICAL FIELD

Embodiments of the present invention relates to a connection arrangement for panels, comprising a first panel having a first main plane and a second panel having a second main plane. The first main plane is essentially perpendicular to the second main plane in a connected state. The second panel comprises a groove on a first face adapted to receive a first protruding edge integrally formed with the first panel, wherein the groove has a longitudinal recess on a side of the groove for receiving a flexible locking element. The protruding edge has a longitudinal insertion recess on one side of the protruding edge for holding the flexible locking element.

BACKGROUND

Assembling two or more objects into one piece, for instance furniture, has historically required tools such as drills, screwdrivers, hammers, and wrenches. Also, sometimes glue is needed.

WO 2012/154113 A1 discloses a set of panels that comprises a first and a second panel. An edge of the second panel is insertable into a groove of the first panel when the panels are arranged essential perpendicular to each other, to obtain a mechanical connection between the first and the second panel when the second panel is displaced essentially perpendicularly to the first panel. Said edge comprises a separate and flexible tongue and said groove comprises a tongue groove, or said edge comprises a tongue groove and said groove comprises a separate and flexible tongue. The separate and flexible tongue is insertable into the tongue groove for connecting said panels to each other in a first direction, which is parallel to a main plane of the first panel. The edge of the second panel is configured to cooperate with the groove of the first panel for connecting said panels to each other in a second direction, which is parallel to a main plane of the second panel. The length direction of the separate and flexible tongue extends parallel with said edge and/or groove. The groove comprises an opening, two side walls, and a bottom. The separate and flexible tongue is arranged in an insertion groove. The separate and flexible tongue has an inner part mounted in the insertion groove and an outer part extending outside an opening of the insertion groove. The flexible tongue is displaceable inwardly towards a bottom of the insertion groove and outwardly into the tongue groove during locking.

SUMMARY

It is an object of an embodiment of the present invention to provide an improved connection arrangement for panels. Accordingly, embodiments of the present invention may mitigate, alleviate, or eliminate one or more deficiencies, disadvantages, or issues of prior art.

According to a first aspect of the present disclosure a connection arrangement for panels is provided comprising a first panel having a first main plane and a second panel having a second main plane, wherein the first main plane is essentially perpendicular to the second main plane in a connected state. The second panel comprises a groove on a first face adapted to receive a first protruding edge integrally formed with the first panel, such as formed in one piece with the first panel. The groove has a longitudinal recess on a side of the groove for receiving a flexible locking element. The protruding edge has a longitudinal insertion recess on one side of the protruding edge for holding the flexible locking element.

The groove comprises at least a first groove section and an adjacent groove section connected by an intermediate groove section. The first edge comprises at least a first protruding section and an adjacent protruding section. The first groove section is configured to cooperate with the first protruding section, and the adjacent groove section is configured to cooperate with the adjacent protruding section.

The first groove section and the adjacent groove section may be longitudinal grooves which may be positioned after each other on the first face, such as after each other in a length direction of the longitudinal grooves.

Having the groove divided into two or more sections helps to increase the strength of the panel, especially between the groove and the edge of the panel. A wall between the groove and the edge of the panel may be relatively thin. Diving the groove into groove sections introduces an intermediate groove section between two groove sections. Thus, the intermediate groove section functions as a reinforcement.

In an embodiment, the intermediate groove section is a bridging part where no, or essentially no, material has been removed, such that the bridging part has the same, or essentially the same, thickness as the thickness of the remainder of the panel.

In an embodiment, the intermediate groove section between the first groove section and the adjacent groove section is a groove with a depth that is less than a depth of the first and adjacent groove sections, wherein an intermediate groove section between the first protruding section and the adjacent protruding section has a height that is less than a height of the first and adjacent protruding sections. The intermediate groove section of the groove should thus be shallow enough to still provide a reinforcement of the groove. Also, in combination with the intermediate protruding section, the intermediate groove section ensures that there is no gap between the two panels such that, for instance, light cannot pass through.

According to yet another aspect of the present disclosure, the length of one of the protruding sections is greater than the length of the other protruding section. Varying the length in such a way may help orient the panel upon assembly.

According to a similar aspect of the present disclosure, the length of one of the groove sections is greater than the length of the other groove section. As with the protruding sections mentioned above, the varying lengths may help orient the panel upon assembly. Also, combining the varying lengths of the protruding sections with the varying lengths of the groove sections may be made such that the panels only can be assembled in one way in order to avoid incorrect assembly.

According to an alternative aspect of the present disclosure, a first height of one of the protruding sections is greater than the height of the other protruding section. As with the lengths above, the varying heights of the protruding sections may be used to assist in arranging the panels correctly to one another.

According to yet an alternative aspect of the present disclosure, a first depth of one of the groove sections is less than the depth of the other groove section. As with the varying heights of the protruding sections disclosed previously, the varying depths of the groove sections may assist in arranging the panels in a correct way.

The varying heights of the protruding sections and the varying depths of the groove sections may be combined in a manner such that it is only possible to connect the panels to one another in only one way. More specifically, the first height of one of the protruding sections is greater than the first depth of one of the groove sections such that the protruding section is not able to be fully inserted into the groove section.

According to yet a further aspect of the present disclosure, the length of the protruding sections is less than the length of the corresponding groove sections at each end of the protruding sections corresponding to the height of the protruding sections. When assembling panels, it is not always possible to push the edge with the protruding sections straight into the groove sections, rather, one end has to be placed in a groove section and the remaining protruding section/sections needs to be shoved longitudinally into the groove sections. Hence, it is beneficial to have the lengths of the protruding sections shorter than just to have a tight fit with the groove sections.

According to an aspect of the present disclosure, the outer ends of the protruding sections are beveled for facilitating assembly of the panels.

According to another aspect of the present disclosure, the second panel has an opening on an edge of the panel extending into the longitudinal recess of the groove for allowing an unlocking tool to be inserted thereinto. If the panels are temporarily to be disassembled, this opening allows for a tool to be inserted in the connection such that the flexible locking element is pushed out of the recess in the groove allowing for the panels to be easily separated.

At least one intermediate groove section between two adjacent groove sections in the groove on the second panel has according to a further aspect of the present disclosure a recess adapted to receive a dowel arranged between two protruding sections on the first edge of the first panel. This dowel arrangement decreases the risk of the panels sliding relative each other and thereby increases the overall strength of the cabinet. Should there be panel connection with several protruding sections and corresponding sections in the groove, i.e., more than two, more than one dowel and recess could be used to further increase the strength of the connection and also the cabinet. A further alternative solution is to have one protruding section having a length that is closer to the length of the corresponding section in the groove such that when fully inserted will minimize relative movement of the panels to one another. Depending on the number of protruding sections, more than one with an increased length could of course be used.

The groove may be formed by mechanical cutting, such as milling, of the second panel.

The first protruding edge may be formed by mechanical cutting, such as milling, of the first panel.

The first panel and/or the second panel may comprise wood based materials, such as particle boards plywood board, HDF-board, MDF-board, and solid wood.

The flexible locking element may comprise a polymer material, such as a thermoplastic or a thermosetting plastic.

The flexible locking element may be an injection moulded or extruded component which may comprise a polymer material, such as a thermoplastic.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features, and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
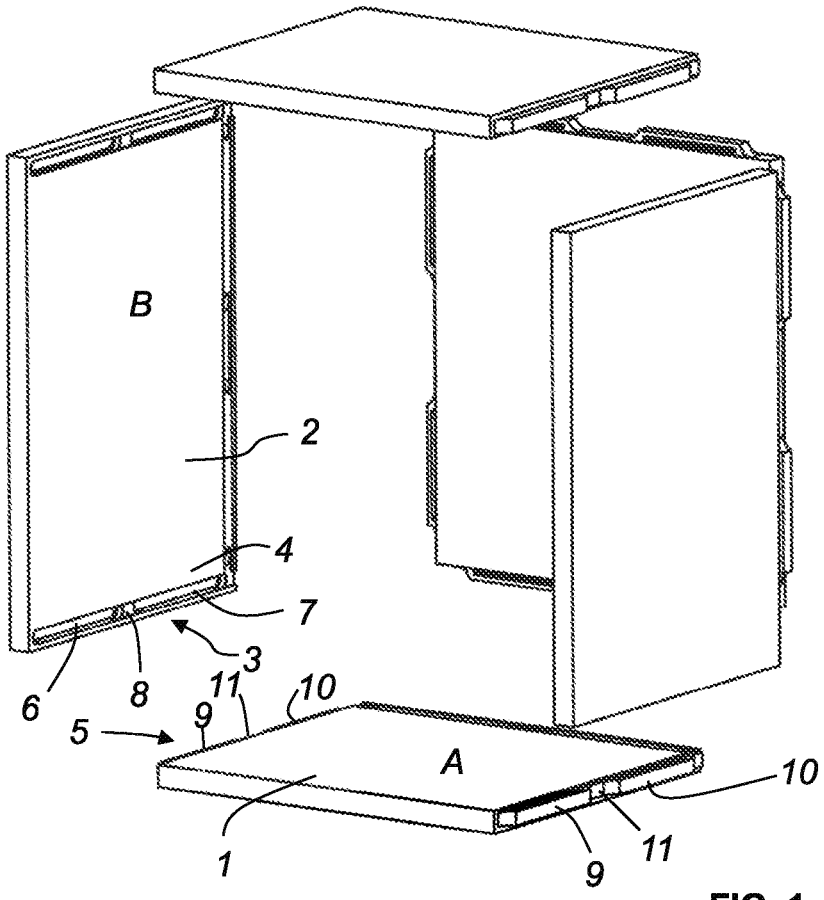
FIG. 1 is an exploded perspective view of a cabinet.

Specific embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

With reference to FIG. 1, a non-assembled cabinet is shown. The connection arrangement comprises a first panel 1 having a first main plane A and a second panel 2 having a second main plane B. The first main plane A is essentially perpendicular to the second main plane B in a connected state. The second panel 2 comprises a groove 3 on a first face 4 adapted to receive a first protruding edge 5 which is formed in one piece with the first panel 1. The groove 3 has a longitudinal recess 12, see FIG. 8, on a side of the groove 3 for receiving a flexible locking element 13, see FIG. 5. The protruding edge 5 has a longitudinal insertion recess 14, see FIGS. 3 and 4, on one side of the protruding edge 5 for holding the flexible locking element 13.

The groove 3 comprises at least a first groove section 6 and an adjacent groove section 7 connected by an intermediate groove section 8. In embodiments, the intermediate groove section 8 may be a bridging part.

The first protruding edge 5 comprises a first protruding section 9 and an adjacent protruding section 10. The first groove section 6 is configured to cooperate with the first protruding section 9, and the adjacent groove section 7 is configured to cooperate with the adjacent protruding section 10. The outer ends of the protruding sections 9, 10 may be beveled.

The groove 3 may be formed by mechanical cutting, such as milling, of the second panel 2.

The first protruding edge 5 may be formed by mechanical cutting, such as milling, of the first panel 1.

The first panel 1 and/or the second panel 2 may comprise wood based materials, such as a particle board, plywood board, an HDF-board, an MDF-board, and solid wood.

The flexible locking element 13 may comprise a polymer material, such as a thermoplastic or a thermosetting plastic.

The flexible locking element 13 may be an injection moulded or extruded component which may comprise a polymer material, such as a thermoplastic.

Figure 2:
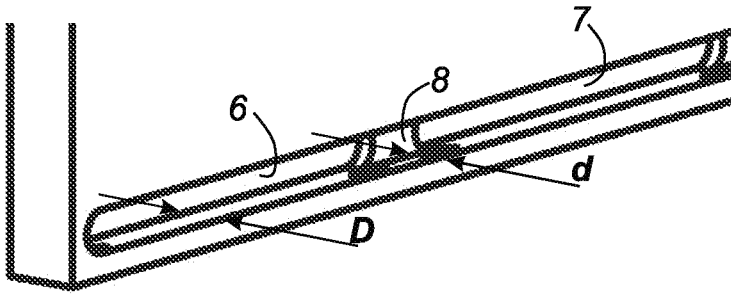
FIG. 2 is an enlarged portion of a panel shown in FIG. 1.

In FIG. 2, it is shown more clearly that the intermediate groove section 8 between the first groove section 6 and the adjacent groove section 7 is a groove with a depth d which is less than a depth D of the first groove section 6 and the adjacent groove section 7, respectively.

The depth D of the first groove section 6 and the adjacent groove section 7 may be in the range of 8 mm to 12 mm, such as 10 mm.

Figure 3:
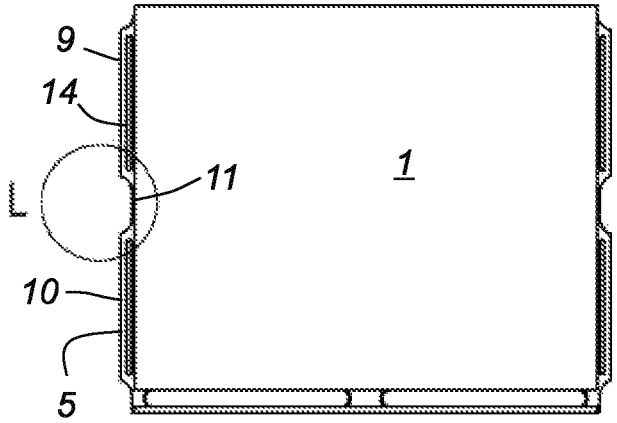
FIG. 3 is a plane view of a panel according to the present disclosure.
Figure 4:
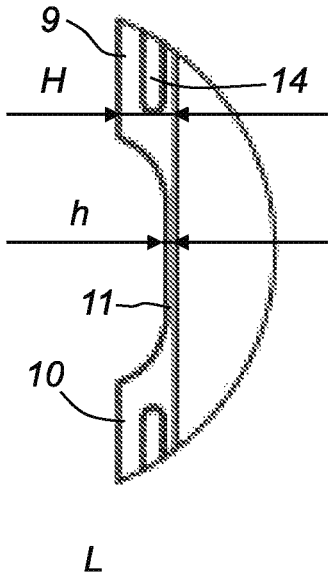
FIG. 4 is an enlarged view of segment L in FIG. 3.

FIG. 3 shows an embodiment of the first panel 1 and FIG. 4 shows an enlargement of the encircled area L in FIG. 3. The embodiment of the first panel comprises an intermediate protruding section 11 between the first protruding section 9 and the adjacent protruding section 10. The intermediate protruding section 11 has a height h which is less than a height H of the first protruding sections 10 and the adjacent protruding sections 10, respectively.

Figure 5:
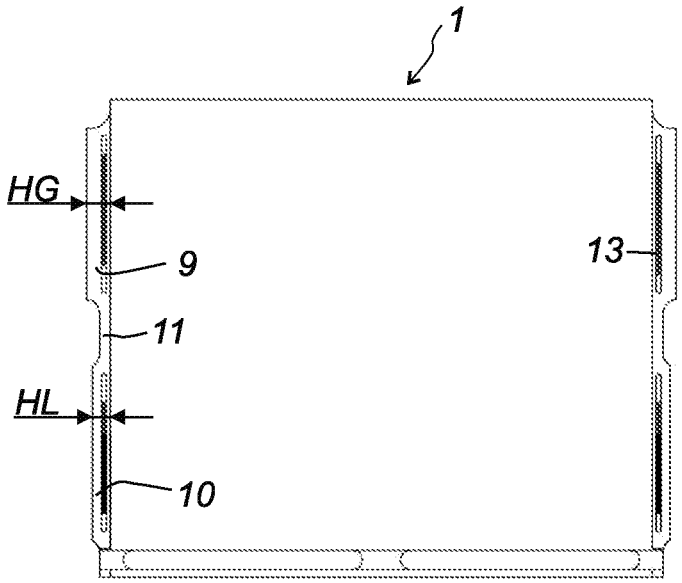
FIG. 5 is a plane view of an alternative embodiment of a panel of the present disclosure.

FIG. 5 shows an embodiment of the first panel 1. A first height HG of the first protruding section 9 is in this embodiment greater than a height HL of the adjacent protruding section 10.

Figure 6:
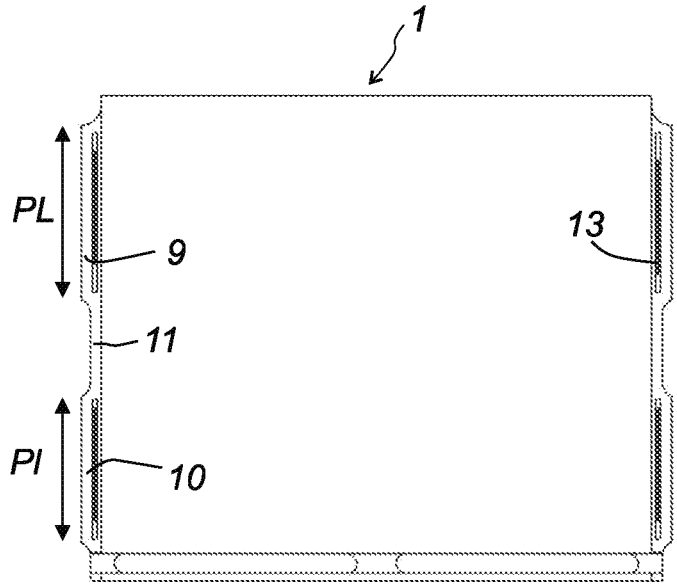
FIG. 6 is a plane view of a further alternative embodiment of a panel of the present disclosure.

FIG. 6 shows an embodiment of the first panel 1. A length PL of the first protruding section 9 is in this embodiment greater than a length PI of the adjacent protruding section 10.

Figure 7:
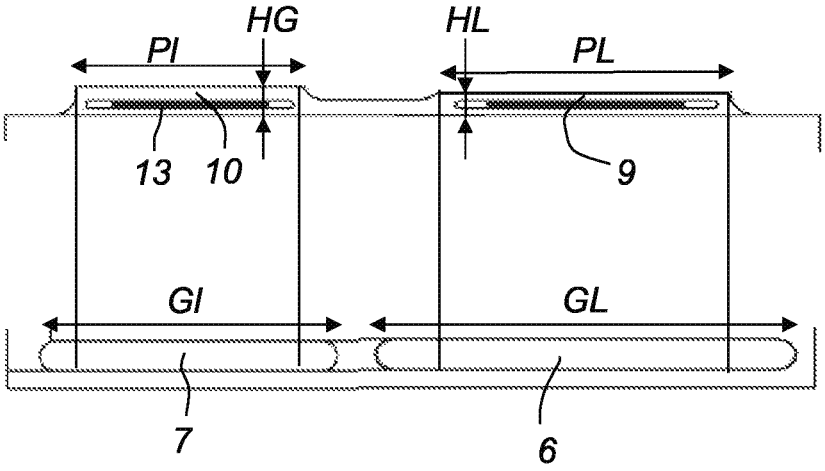
FIG. 7 is an illustration of protruding sections and grooves of an alternative embodiment of the present disclosure.

FIG. 7 shows embodiments of the first protruding section 9 and the adjacent protruding section 10 arranged above corresponding embodiments of the first groove sections 6 and adjacent groove sections 7 for facilitating understanding of the various lengths etc. The length GL of first groove section 6 is greater than the length GI of the adjacent groove section 7.

The length PI of the first protruding section 9 may be less than the length GI of the corresponding first groove section 6. The length PL of the first protruding section 9 may be measured at its outermost edge.

The length PL of the adjacent protruding section 10 may be less than the length of the corresponding adjacent groove section 7. The length PL of the adjacent protruding section 10 may be measured at its outermost edge.

Figure 8:
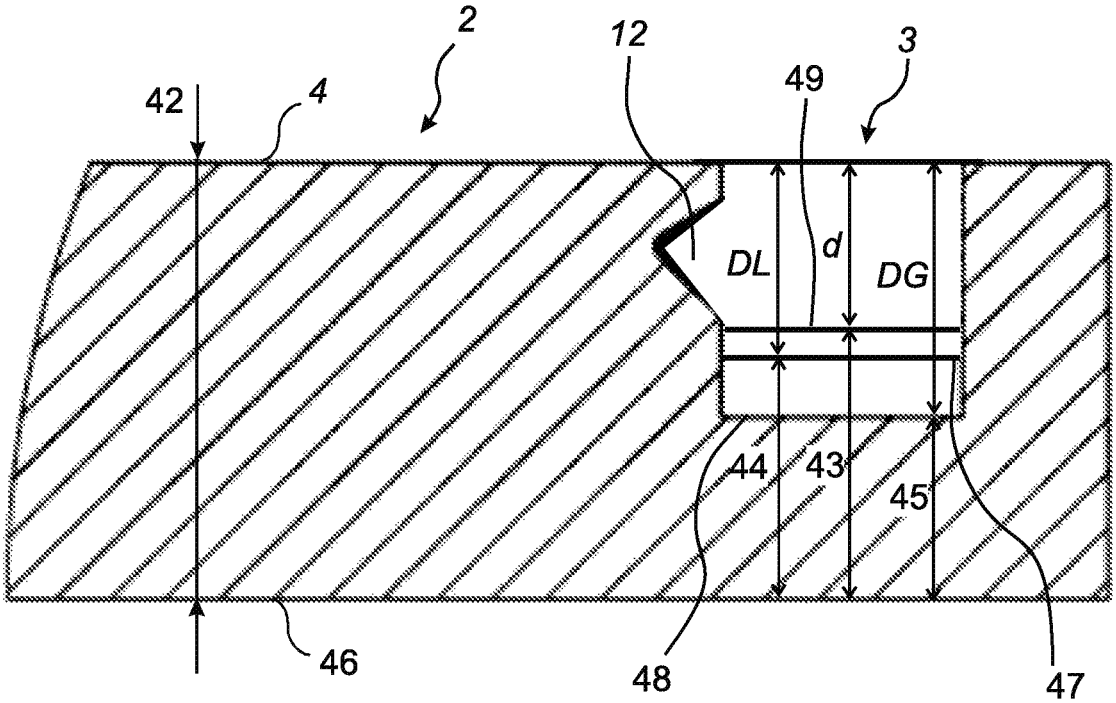
FIG. 8 is a partial cross section of panel showing a groove according to an embodiment of the present disclosure.

FIG. 8 shows an embodiment of the groove 3. In this embodiment a first depth DL of the first groove section 6 may be less than a depth DG of the adjacent groove section 7. The depth d of the intermediate groove section 8 may be less the first depth DL of the first groove section 6.

The first depth DL of the first groove section 6 may be measured between the first face 4 of the second panel 2 and a bottom surface 47 of the first groove section 6.

The first depth DG of the adjacent groove section 7 may be measured between the first face 4 of the second panel 2 and a bottom surface 48 of the adjacent groove section 6.

The depth d of the intermediate groove section 8 may be measured between the first face 4 of the second panel 2 and a bottom surface 49 of the intermediate groove section 8.

In other embodiments the first depth DL of the first groove section 6 may be the same as the depth DG of the adjacent groove section 7.

A panel thickness 43 of the intermediate groove section 8 may be greater than a panel thickness 44 of the first groove section 6 and a panel thickness 45 of the adjacent groove section 7.

The panel thickness 42 of the second panel 2 may be measured between the first face 4 of the second panel 2 and an opposite face 46 of the second panel 2.

The panel thickness 43 of the intermediate groove section 8 may be measured between the bottom surface 49 of the intermediate groove section 8 and the opposite face 46 of the second panel 2.

The panel thickness 44 of the first groove section 6 may be measured between the bottom surface 47 of the first groove section 6 and the opposite face 46 of the second panel 2.

The panel thickness 45 of the adjacent groove section 7 may be measured between the bottom surface 48 of the adjacent groove section 7 and the opposite face 46 of the second panel 2.

The intermediate groove section 8 between the first groove section 6 and the adjacent groove section 7 may be a bridging part with essentially the same thickness as a thickness 42 of the remainder of the second panel 2.

The first height HG of one of the protruding sections may be greater than the first depth DL of one of the groove sections. For instance, in FIGS. 7 and 8, the height HG of protruding section 10 is greater than the depth DL of first groove section 6 such that the entire protruding section 10 cannot enter fully into the first groove section 6. The depth d of the intermediate groove section 8 could be varied.

If it is a requirement to have the option to separate the panels without damaging the panels, the depth d of the intermediate groove section should be at least enough to go to same level as the bottom most part of the longitudinal recess 12. This is shown in FIG. 8.

Thus, an unlocking tool can be inserted in the longitudinal recess 12 through both groove sections, i.e., the first groove section and the second groove section, from one side. For regular panels used in homes, for instance in a kitchen cabinet, the depth d of the intermediate groove section may be in the range of 5 mm to 10 mm, such as 6 mm to 7 mm.

Figure 9A:
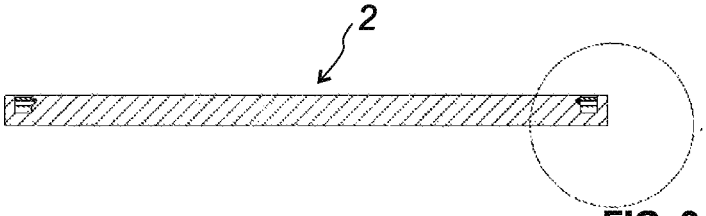
FIG. 9A is a sideview of a panel of the present disclosure.
Figure 9B:
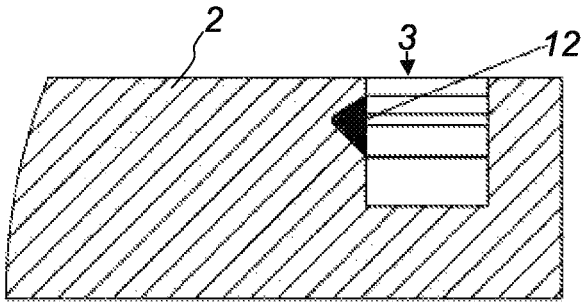
FIG. 9B is an enlarged portion of FIG. 9B.
Figure 10A:
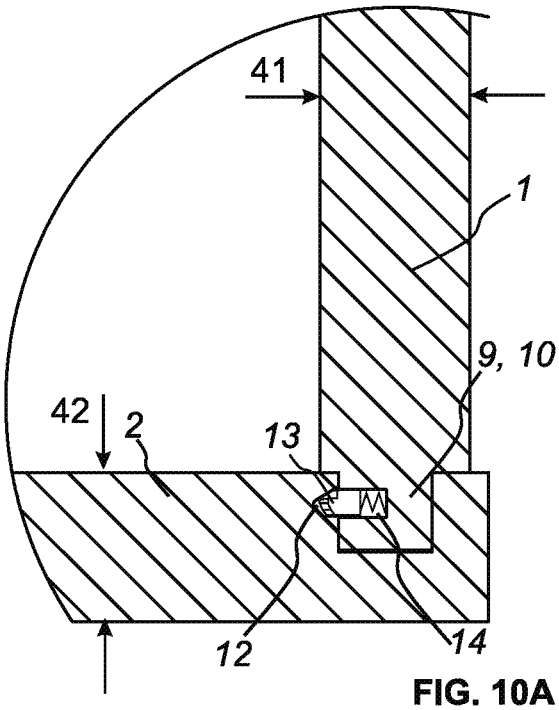
FIG. 10A shows the connection between two panels.

FIGS. 9A and 9B, FIG. 9B being an enlarged portion of FIG. 9A, show the groove 3 in more detail and especially the longitudinal recess 12. In FIG. 10A, two panels are connected and the flexible locking element 13 has flexed outwards from the longitudinal recess 14 of the protruding section 9, 10 into the longitudinal recess 12, see FIG. 10A, of the groove 3 and thereby locking the two panels in an assembled position.

A thickness 41 of the first panel 1 and/or a thickness 42 of the second panel 2 may be in the range of about 8 mm to 25 mm, such as 15 mm to 20 mm, such as 16 mm to 19 mm. The first panel and the second panel may have the same, or different, thicknesses 41, 42.

Figure 10B:
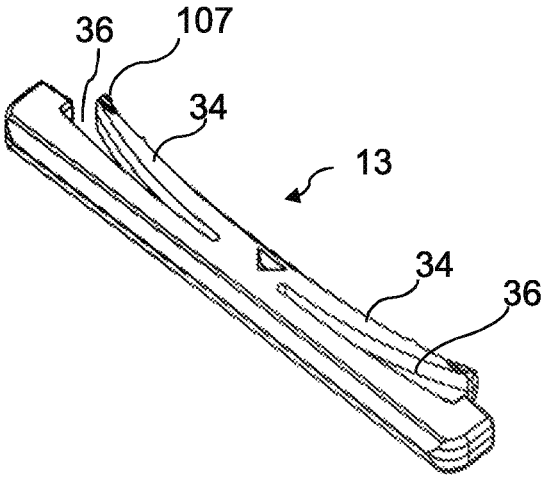
FIG. 10B is a perspective view of a flexible locking element.

FIG. 10B shows in a 3D-view an embodiment of the flexible locking element 13. The flexible locking element 13 may comprise a bendable portion 34, such as a first bendable portion and a second bendable portion. The flexible tongue 33 may comprise a recess 36 at each of said bendable portions 34. An advantage with this embodiment of the flexible tongue is that a stronger spring force may be obtained which may provide a stronger locking.

The flexible locking element 13 may comprise an outer edge, with a beveled or rounded shape.

The flexible locking element 13 may comprise a protruding friction element 107 on the first and/or second bendable portion 34.

Figure 10C:
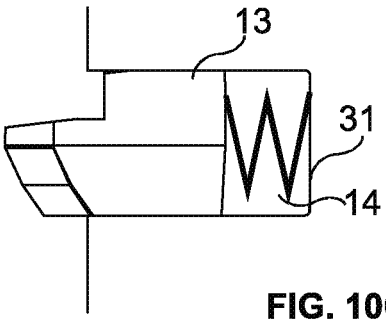
FIGS. 10C and 10D show an embodiment of the flexible locking element arranged in an embodiment of the longitudinal insertion recess.

FIG. 10C shows in a cross-cut view an embodiment of the flexible locking element 13 arranged in an embodiment of the longitudinal insertion recess 14.

Figure 10D:
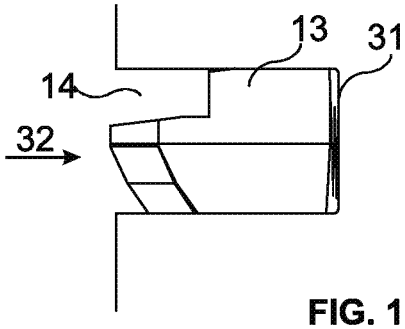

FIG. 10D shows in a cross-cut view that an embodiment of the flexible locking element 13 may be compressed in a direction 32 toward a bottom surface 31 of an embodiment of the longitudinal insertion recess 14. The flexible locking element 13 may be compressed to a compressed state in which essentially the whole flexible locking element is within the longitudinal insertion recess 14. The compressed state may facilitate an assembling of the panels.

Figure 11A:
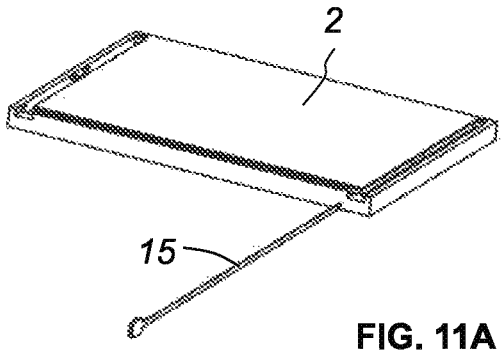
FIGS. 11A and 11B show a panel with an unlocking tool.
Figure 11B:
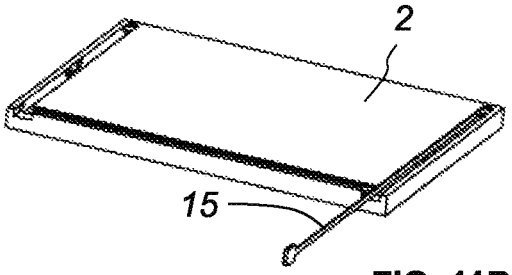
Figure 12:
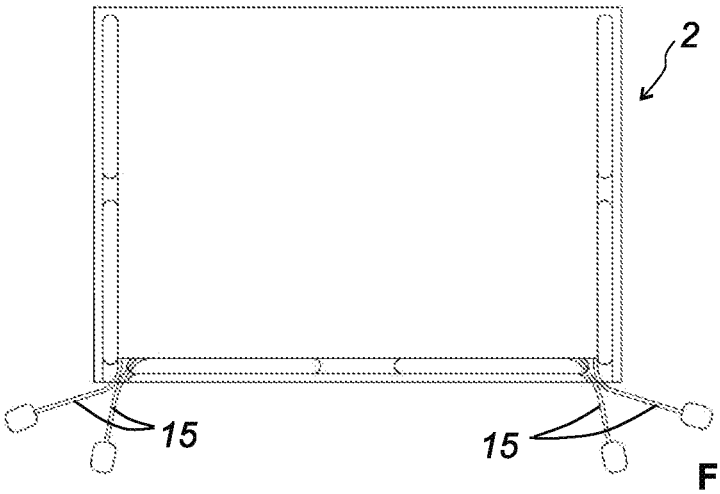
FIG. 12 shows a panel with several unlocking tools.
Figure 13A:
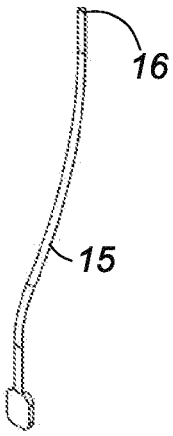
FIGS. 13A and 13B show an unlocking tool.
Figure 13B:
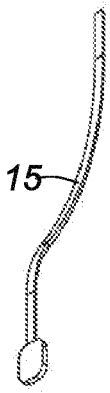

FIGS. 11A and 11B show a panel with a groove that has an opening on an edge of the panel extending into the longitudinal recess 12 of the groove 3 for allowing an unlocking tool/release key 15 to be inserted thereinto. When disconnecting two panels from one another, the unlocking tool 15 is inserted and pushed along the longitudinal recess 12 of the groove 3 such that the flexible locking tool 13 is pushed out of the longitudinal recess 12. When fully inserted the two panels are possible to disconnect without damaging them. FIG. 12 shows an embodiment of a panel with several unlocking tools 15 that are flexible such that they can be bent when unlocking two panels from one another. FIGS. 13A and 13B show the unlocking tool 15 in different bent states. The unlocking tool 15 may be flexible in all directions which makes it possible to insert unlocking tools 15 in different directions and unlock more than one panel at the same time. As can be seen at the tip 16 of the embodiment in FIG. 13A, the unlocking tool 15 may have a triangular cross section. The longitudinal recess 12 shown in FIGS. 8 and 9B may have also a triangular cross section. Thus, when the unlocking tool 15 is fully inserted, the unlocking tool may fill up more or less the entire longitudinal recess 12 such that no part of the flexible locking element 13 is left in the longitudinal recess 12, and the panels can be separated. Other shapes than a triangular shape are possible to have of the longitudinal recess, however, then the cross section of the unlocking tool may be adapted to have compatible shape to be able to push the flexible locking element out of the longitudinal recess.

Figure 14A:
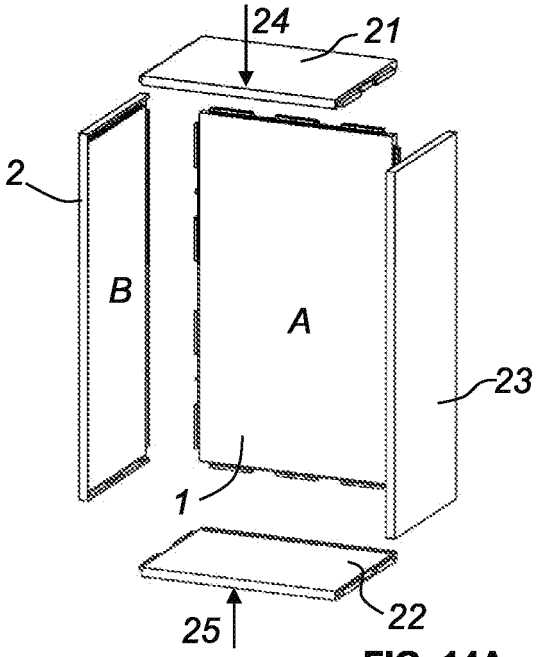
FIGS. 14A to 14C show a cabinet with panels having an additional connecting part.
Figure 14B:
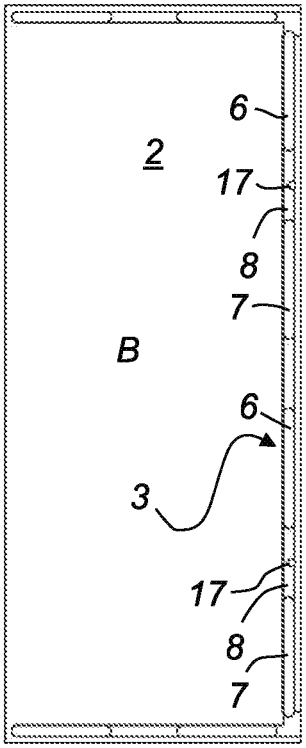

FIG. 14B shows an embodiment of the second panel 2 which comprises two intermediate groove sections 8 between two adjacent groove sections 6, 7 in the groove 3. The intermediate groove sections 8 comprise recesses 17.

Figure 14C:
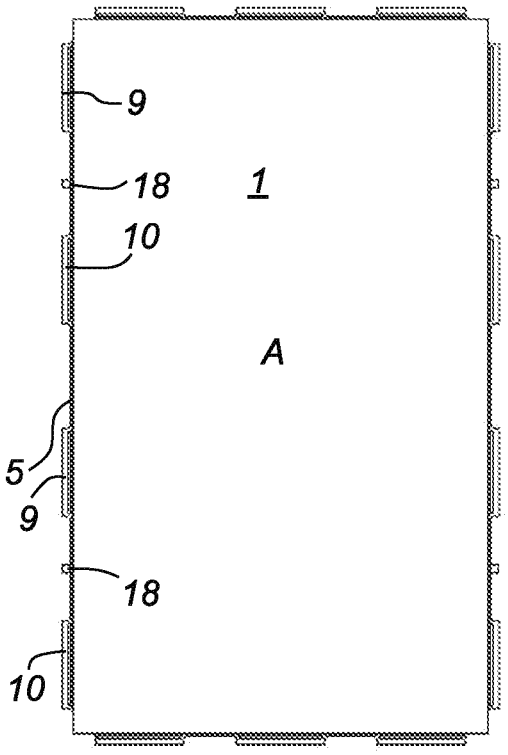

FIG. 14C shows an embodiment of the first panel which comprises dowels 18 arranged between adjacent protruding sections 9, 10 on the first edge 5 of the first panel 1. The dowels 18 may be configured to be inserted in the recesses 17. This could be advantageous from a strength point of view since the first panel 1 would be prevented from sliding in the groove 3 of the second panel 2.

The protruding sections 9, 10 of the first panel 1 may be shorter than the sections 6, 7 of the second panel 2. The dowels 18 and the recess 17 may be configured to in the assembled state counteract a relative movement between the first panel 1 and the second panel 2.

In the shown embodiment, there are two dowels 18 and two recesses 17. Embodiments may only have one pair of a dowel and a recess or more than two pairs.

FIG. 14A shows a cabinet which may comprise the second panel 2 in FIG. 14B, the first panel 1 in FIG. 14C. The second panel 2 may be a side panel and the first panel 1 may be a back panel. The cabinet may further comprise a bottom panel 22, a top panel 21 and another opposite side panel 23.

The dowels 18 and the recesses 17 may increase the strength of the assembled cabinet. The strength may be measured by applying a load 25 on the bottom panel 22 or a load 24 the top panel 21. The strength may be measured according to ANSI/KCMA 5.2 static load.

Further embodiments are described below:

1. A connection arrangement for panels, comprising a first panel 1 having a first main plane A, a second panel 2 having a second main plane B, the first main plane A is essentially perpendicular to the second main plane B in a connected state, wherein the second panel 2 comprises a groove 3 on a first face 4 adapted to receive a first protruding edge 5 integrally formed with the first panel 1, the groove 3 having a longitudinal recess 12 on a side of the groove 3 for receiving a flexible locking element 13, wherein the first protruding edge 5 has a longitudinal recess 14 on one side of the first protruding edge 5 for holding the flexible locking element 13, wherein the groove 3 comprises at least a first groove section 6 and an adjacent groove section 7 connected by an intermediate groove section 8, and wherein the first protruding edge 5 comprises at least a first protruding section 9 and an adjacent protruding section 10, wherein the first groove section 6 is configured to cooperate with the first protruding section 9, and the adjacent groove section 7 is configured to cooperate with the adjacent protruding section 10.
2. The connection arrangement according to embodiment 1, wherein the intermediate groove section 8 between the first groove section 6 and the adjacent groove section 7 is a groove with a depth d that is less than a depth D of the first and adjacent groove sections 6, 7, wherein an intermediate protruding section 11 between the first protruding section 9 and the adjacent protruding section 10 has a height h that is less than a height H of the first and adjacent protruding sections 9, 10.
3. The connection arrangement according to any of the preceding embodiments, wherein a length PL of one of the first protruding section 9 and the adjacent protruding section 10 is greater than a length PI of the other of the first protruding section 9 and the adjacent protruding section 10.
4. The connection arrangement according to embodiment 3, wherein a length GL of one of the first groove section 6 and the adjacent groove section 7 is greater than a length GI of the other of the first groove section 6 and the adjacent groove section 7.
5. The connection arrangement according to any of the preceding embodiments, wherein a first height HG of one of the first protruding section 9 and the adjacent protruding section 10 is greater than a height HL of the other of the first protruding section 9 and an adjacent protruding section 10.

6. The connection arrangement according to embodiment 5, wherein a first depth DL of one of the first groove section 6 and the adjacent groove section 7 is less than a depth DG of the other of the first groove section 6 and the adjacent groove section 7.
7. The connection arrangement according to embodiment 6, wherein the first height HG of one of the protruding sections 9, 10 is greater than the first depth DL of one of the first groove section 6 and the adjacent groove section 7.
8. The connection arrangement according to any of the preceding embodiments, wherein a length PL, PI of the first protruding section 9 and the adjacent protruding section 10, respectively, is less than a length GL, GI of the corresponding first groove section 6 and the adjacent groove section 7, respectively.
9. The connection arrangement according to any of the preceding embodiments, wherein outer ends of the protruding sections 9, 10 are beveled.
10. The connection arrangement according to any of the preceding embodiments, wherein the second panel 2 has an opening on an edge of the panel extending into the longitudinal recess 12 of the groove 3 for allowing an unlocking tool 15 to be inserted thereinto.
11. The connection arrangement according to any of the preceding embodiments, wherein at least one intermediate groove section 8 between two adjacent groove sections 6, 7 in the groove 3 on the second panel 2 has a recess 17 adapted to receive a dowel 18 arranged between two protruding sections 9, 10 on the first edge 5 of the first panel 1.

The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the appended claims. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

The invention claimed is:

1. A connection arrangement for panels, comprising a first panel having a first main plane, and a second panel having a second main plane, wherein the first main plane is essentially perpendicular to the second main plane in a connected state, wherein the second panel comprises a groove on a first face adapted to cooperate with a first protruding edge which is formed in one piece with the first panel, wherein the first protruding edge comprises a longitudinal insertion recess at a side of the first protruding edge, wherein a flexible locking element is arranged in the longitudinal insertion recess, wherein a side of the groove comprises a longitudinal recess which is configured to cooperate with the flexible locking element in the connected state, wherein the groove comprises, in a longitudinal extent along the first face, at least a first groove section, an intermediate groove section, and an adjacent groove section, wherein the intermediate groove section is longitudinally between the first groove section and the adjacent groove section, wherein a panel thickness of the intermediate groove section is greater than a panel thickness of the first groove section and a panel thickness of the adjacent groove section, wherein the first protruding edge comprises at least a first protruding section and an adjacent protruding section, and wherein the first groove section is configured to cooperate with the first protruding section and the adjacent groove section is configured to cooperate with the adjacent protruding section in the connected state, wherein the first protruding edge has an end facing a first direction and the first and adjacent protruding sections extend outward at the end of the first protruding edge in the first direction.

2. The connection arrangement according to claim 1, wherein the intermediate groove section between the first groove section and the adjacent groove section is a groove with a depth that is less than a depth of the first and adjacent groove sections, wherein an intermediate protruding section between the first protruding section and the adjacent protruding section has a height that is less than a height of the first and adjacent protruding sections.

3. The connection arrangement according to claim 1, wherein the intermediate groove section between the first groove section and the adjacent groove section is a bridging part with essentially the same thickness as a thickness of the remainder of the second panel.

4. The connection arrangement according to claim 1, wherein a length of one of the first protruding section and the adjacent protruding section is greater than a length of the other of the first protruding section and the adjacent protruding section.

5. The connection arrangement according to claim 4, wherein a length of one of the first groove section and the adjacent groove section is greater than a length of the other of the first groove section and the adjacent groove section.

6. The connection arrangement according to claim 1, wherein a first height of one of the first protruding section and the adjacent protruding section is greater than a height of the other of the first protruding section and the adjacent protruding section.

7. The connection arrangement according to claim 6, wherein a first depth of one of the first groove section and the adjacent groove section is less than a depth of the other of the first groove section and the adjacent groove section.

8. The connection arrangement according to claim 7, wherein the first height of one of the protruding sections is greater than the first depth of one of the first groove section and the adjacent groove section.

9. The connection arrangement according to claim 1, wherein a length of the first protruding section and the adjacent protruding section, respectively, is less than a length of the corresponding first groove section and the adjacent groove section, respectively.

10. The connection arrangement according to claim 1, wherein outer ends of the protruding sections are beveled.

11. The connection arrangement according to claim 1, wherein the second panel has an opening on an edge of the panel extending into the longitudinal recess of the groove for allowing an unlocking tool to be inserted thereinto.

12. The connection arrangement according to claim 1, wherein at least one intermediate groove section between two adjacent groove sections in the groove on the second panel has a recess adapted to receive a dowel arranged between two protruding sections on the first edge of the first panel.

13. The connection arrangement according to claim 1, wherein the flexible locking element is configured to be compressed towards a bottom surface of the longitudinal insertion recess.

14. The connection arrangement according to claim 13, wherein the flexible locking element comprises a polymer material.

15. The connection arrangement according to claim 1, wherein the first panel and the second panel comprise wood based materials.

16. The connection arrangement according to claim 1, wherein the longitudinal recess is recessed from a side surface of the first groove section.

17. The connection arrangement according to claim 1, wherein, in a locked position of the first and second panels, the first and adjacent protruding sections protrude in a direction perpendicular to the first face.

* * * * *